US009162267B2

(12) United States Patent
Hayashi et al.

(10) Patent No.: US 9,162,267 B2
(45) Date of Patent: Oct. 20, 2015

(54) EXTRUSION DIE FOR FORMING HOLLOW MATERIAL

(75) Inventors: Haisei Hayashi, Shizuoka (JP); Yuji Mochizuki, Shizuoka (JP); Shigenori Saito, Tokyo (JP); Kenji Yuza, Tokyo (JP); Hiroaki Sata, Shizuoka (JP); Hirohumi Sugihara, Shizuoka (JP)

(73) Assignees: Nippon Light Metal Company, Ltd., Tokyo (JP); Nikkeikin Aluminium Core Technology Co., Ltd., Tokyo (JP)

( * ) Notice: Subject to any disclaimer, the term of this patent is extended or adjusted under 35 U.S.C. 154(b) by 0 days.

(21) Appl. No.: 14/344,484

(22) PCT Filed: Aug. 2, 2012

(86) PCT No.: PCT/JP2012/069723

§ 371 (c)(1),
(2), (4) Date: Mar. 12, 2014

(87) PCT Pub. No.: WO2013/038831

PCT Pub. Date: Mar. 21, 2013

(65) Prior Publication Data

US 2014/0283577 A1 Sep. 25, 2014

(30) Foreign Application Priority Data

Sep. 13, 2011 (JP) ..... 2011-199793

(51) Int. Cl.
*B21C 25/02* (2006.01)
*B21C 23/08* (2006.01)
*B21C 25/00* (2006.01)

(52) U.S. Cl.
CPC ..... *B21C 25/02* (2013.01); *B21C 23/085* (2013.01); *B21C 25/00* (2013.01)

(58) Field of Classification Search
CPC ..... B21C 23/085; B21C 25/02; B21C 25/00
USPC ..... 72/269, 467; 76/107.1
See application file for complete search history.

(56) References Cited

U.S. PATENT DOCUMENTS 3,834,209 A * 9/1974 Robertson ..... 72/468
3,918,288 A * 11/1975 Verduzco et al. ..... 72/467

(Continued)

FOREIGN PATENT DOCUMENTS

CN 2304481 1/1999
CN 101648229 2/2010

(Continued)

OTHER PUBLICATIONS

English Abstract of JP 2010125475.

(Continued)

*Primary Examiner* — David B Jones
(74) *Attorney, Agent, or Firm* — Dykema Gossett PLLC

(57) ABSTRACT

An extrusion die is provided with a male die through which a billet is extruded from an upstream side to a downstream side and, the male die adapted for forming an inside shape of a hollow material; and a female die for holding the male die and forming an outside shape of the hollow material. The male die is formed of a spider and a holder for holding the spider. The spider is formed of a mandrel and a plurality of bridge parts for supporting the mandrel, and enabling a distal-end outer peripheral surface to engage with a bridge-holding surface. The distal-end outer peripheral surface of each of the bridge parts and the bridge-holding surface of the holder are joined by shrink-fitting.

4 Claims, 20 Drawing Sheets

(56) References Cited

U.S. PATENT DOCUMENTS

| | | | | |
|---|---|---|---|---|
| 4,270,380 | A * | 6/1981 | Gulati et al. | 72/467 |
| 7,237,418 | B2 * | 7/2007 | Maeno et al. | 76/107.1 |
| 7,469,569 | B2 * | 12/2008 | Webb | 72/467 |

FOREIGN PATENT DOCUMENTS

| | | |
|---|---|---|
| JP | 2-20614 | 1/1990 |
| JP | 03207520 | 9/1991 |
| JP | 4274820 | 9/1992 |
| JP | 6-134518 | 5/1994 |
| JP | 7-124633 | 5/1995 |
| JP | 10258309 | 9/1998 |
| JP | 11129024 | 5/1999 |
| JP | 2004017129 | 1/2004 |
| JP | 2005059022 | 3/2005 |
| JP | 2009178770 | 8/2009 |
| JP | 2010125475 | 6/2010 |

OTHER PUBLICATIONS

English Abstract of JP 2004017129.
English Abstract of JP 2005059022.
English Abstract of CN 101648229.
English Abstract of JP 06-134518.
English Abstract of JP 07-124633.
English Abstract of JP 02-020614.
English Abstract of JP 10258309.
English Abstract of JP 4274820.
English Abstract of CN 2304481.
English Abstract of JP 03207520.
English Abstract of JP 2009178770.
English Abstract of JP 11129024.

* cited by examiner

EXTRUSION DIE FOR FORMING HOLLOW MATERIAL

TECHNICAL FIELD

The present invention is related to a hollow material forming extrusion die for forming a hollow material constituted with a high-strength alloy, particularly with the so-called 7000-system maximum strength aluminum alloy.

BACKGROUND ART

In general, extrusion processing of aluminum alloy and the like is high in the versatility in terms of the sectional shapes and is excellent for acquiring a hollow material formed by extrusion. Thus, it is being widely employed in these days. Recently in particular, products manufactured by extrusion processing have come to be used broadly as strong members of structural materials, mechanical components, and the like. Thus, there are increasing demands for extruded members constituted with high-strength alloys, particularly with maximum strength aluminum alloys such as the so-called 7000-system, e.g., 7075, 7N01, and 7003.

As an example of a conventional extrusion die for forming a hollow material, there is known a hollow-material extrusion die constituted with the so-called a spider die in which a male die and a female die are mounted inside a die ring (see Patent Document 1, for example).

As shown in FIG. 20, a spider die 100 disclosed in Patent Document 1 is constituted by including: a male die 101 having a core (mandrel) 110 for forming an inside shape of a hollow material; and a female die 102 for forming an outside shape of the hollow material. The male die 101 is constituted by including the mandrel 110 and a male ring 112 that holds the mandrel 110. Further, the mandrel 110 is formed with a forming projected part 113 and bridge legs 111 for holding the forming projected part 113.

Further, a distal-end peripheral side surface 115*b* of a distal-end 115 of the bridge leg 111 forms a slope surface that expands towards the tip side of the extrusion direction. The distal-end peripheral side surface 115*b* is fitted with an inner peripheral surface 112*a* of the male ring 112.

The mandrel 110 includes, on the bottom side thereof, a part that forms the inside shape of the hollow material. In the outer periphery of the mandrel 110, the bridge legs 111 in an X-letter shape, for example, i.e., extended in four directions, towards an inner periphery slope surface 112*a* of the male ring 112 are provided. Further, a space surrounded by the four bridge legs 111 and the inner peripheral surface 112*a* of the male ring 112 is a space S for introducing a billet formed with an aluminum alloy as a material.

The male die 101 is held by the female die 102 at the extrusion direction tip side shown with an arrow A. A forming hole part 106 to which the bottom part of the mandrel 110 is inserted and which is used for forming the outside shape of the hollow material is formed in the female die 102. Further, a holding surface 116 for holding the bottom surfaces of the bridge legs 111 of the male die 101 is formed on the outer periphery side top surface of the female die 102.

As described above, each of the bridge legs 111 in the spider die 100 disclosed in Patent Document 1 is formed as the slope surface in which the distal-end periphery side surface 115*b* of the distal-end 115 becomes expanded towards the tip side of the extrusion direction. Thus, during the extrusion of the billet, the axial force works on each of the bridge legs 111 and the bending stress working on each of the bridge legs 111 is decreased. Thus, the flexure of each of the bridge legs 111 is suppressed, thereby providing a structure with which the holding state of the mandrel 110 during the extrusion becomes stable.

Patent Document 1: Japanese Unexamined Patent Publication Hei 7-124633

In a case where a high-strength alloy, particularly the so-called 7000-system maximum strength aluminum alloy, is used as a material for forming a hollow material and an extruded material having a plurality of hollow parts such as a material in a sectional shape having a rectangle with two vertically parallel lines or the like is formed as a member for automobile dampers, for example, to be formed with the alloy, it is difficult to increase the speed of extrusion and to improve the life of the die since the deformation resistance thereof is higher than those of other alloy types so that the extrusion processing force becomes greater and the load for the die tools becomes greater as well.

For example, the hollow material extrusion die 100 disclosed in Patent Document 1 described above is so structured that the inner periphery slope surface 112*a* of the male ring 112 and the distal-end periphery side surfaces 115*b* of the bridge legs 111 are press-fitted to generate a compression stress to the bridge legs 111 in the direction orthogonal to the extrusion direction. The pressure stress and the extrusion force applied to the top surfaces of each of the bridge legs 111 when extrusion processing is executed, i.e., the tensile force for pulling towards the extrusion direction tip side generated in the shaping extrusion part 113, are set off thereby to prevent damages of the bridge legs 111 and to prevent damages of the mandrel 110 as a result.

However, in the extrusion die 100, the distal-end parts 115 of the bridge legs 111 are sloped in the direction spreading towards the tip side of the extrusion direction. Thus, the distance L between a base end part P1 held on the holding surface 116 of the female die 102 in the distal-end part 115 of the bridge leg 111 and the intersection point between the bridge leg 111 and the shaping extrusion part 113, i.e., a working point P2 that may be broken by the tensile force, becomes larger, so that the moment is increased.

Therefore, when an extrusion force is applied to the mandrel 100, a large weight is applied to the working point P2 so that the bridge legs 111 may be broken.

In order to overcome this issue, it is considered to increase the strength of the bridge legs 111 by increasing the size of the bridge legs 111 or to reduce the moment by shortening the distance L between the base end part P1 and the working point P2.

However, when the size of the bridge 111 is increased, the introduction space S of the billet to which the billet is guided and housed becomes smaller. Thus, the set amount of the billet cannot be secured. In order to secure the set amount of the billet, it is necessary to increase the inside diameter of the male ring 112. To do so, the die becomes large-sized and the distance L is extended, so that the moment cannot be reduced as a result.

Further, when the distance L between the base end part P1 and the working point P2 is shortened, the space between the male ring 112 and each of the bridge legs 111, i.e., the introduction space of the billet S, becomes small. This causes such issues that the extrusion amount of the billet is reduced, etc., so that there is naturally a limit in shortening the distance L.

As described above, with the spider die 100 designed to overcome the issues by offsetting the compression stress and the tensile stress, there is a possibility of breaking the bridge legs 111 as well as the mandrel 110 as a result. Thus, there is also a limit in extending the life of the die.

In order to overcome the issues, it is an object of the present invention to provide an extrusion die for forming a hollow material, which is capable of performing high-speed extrusion and preventing breakage of the mandrel at the same time so as to extend the life even when extrusion-forming a billet (an extruded material) constituted with a high-strength alloy with a high extrusion processing force, particularly constituted with the so-called 7000-system maximum strength aluminum alloy.

DISCLOSURE OF THE INVENTION

In order to achieve the foregoing object, the extrusion die for forming a hollow material according to the present invention is an extrusion die for forming a hollow material, which includes: a male die which forms an inside shape of the hollow material by extruding a billet constituted with an aluminum alloy fed from an upstream side towards a downstream side; and a female which holds the male die and forms an outside shape of the hollow material, wherein:

- the male die includes a spider which forms the inside shape and a holder which holds the spider;
- the spider includes a mandrel which corresponds to the inside shape of the hollow material, and a plurality of bridge parts provided in a unified manner with the mandrel and projected from a periphery of the mandrel towards outside; and
- distal-end outer peripheral surfaces of each of the bridge parts and an inner peripheral surface part of the holder are bonded by shrink-fitting.

The extrusion die for forming the hollow material according to the present invention is structured in the manner described above, so that the distal-end outer peripheral surface of each bridge part of the spider and the inner peripheral surface of the holder are bonded and unified by shrink-fitting. Thus, the stress imposed upon the die can be received by the spider and the holder, so that the stress upon the stress concentrated part of each bridge part can be eased. This makes it possible to prevent the bridge parts of the spider from being broken.

As a result, it becomes possible to perform high-speed extrusion and to extend the life even when extrusion-forming a billet (an extruded material) constituted with a high-strength alloy with a high extrusion processing force, particularly constituted with the so-called 7000-system maximum strength aluminum alloy.

Further, even when the pressure for protruding the billet is applied to the mandrel and each bridge part of the spider, each of the bridge parts of the spider alone is not slightly shifted and is held stably since the distal-end outer peripheral surfaces of each bridge part of the spider and the inner peripheral surface of the holder are bonded and unified by shrink-fitting. As a result, it becomes possible to process the hollow material with a desired high precision.

BEST MODES FOR CARRYING OUT THE INVENTION

Hereinafter, a first embodiment of an extrusion die 10 for forming a hollow material (referred simply to as an extrusion die hereinafter) according to the present invention will be described by referring to FIG. 1 to FIG. 11.

Figure 12:
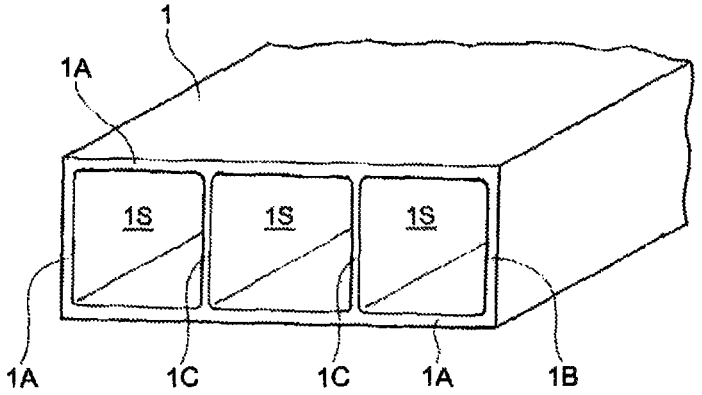
FIG. 12 is a perspective view showing a hollow material in a sectional shape having a rectangle with two vertically parallel lines formed by the hollow material forming extrusion die of the embodiment.

The extrusion die 10 according to the first embodiment is of a spider die type, which forms a hollow material constituted with a high-strength alloy, particularly with the so-called 7000-system maximum strength aluminum alloy. The extrusion die 10 of the embodiment forms a hollow material 1 in a sectional shape having a rectangle with two vertically parallel lines as shown in FIG. 12, for example.

Figure 2:
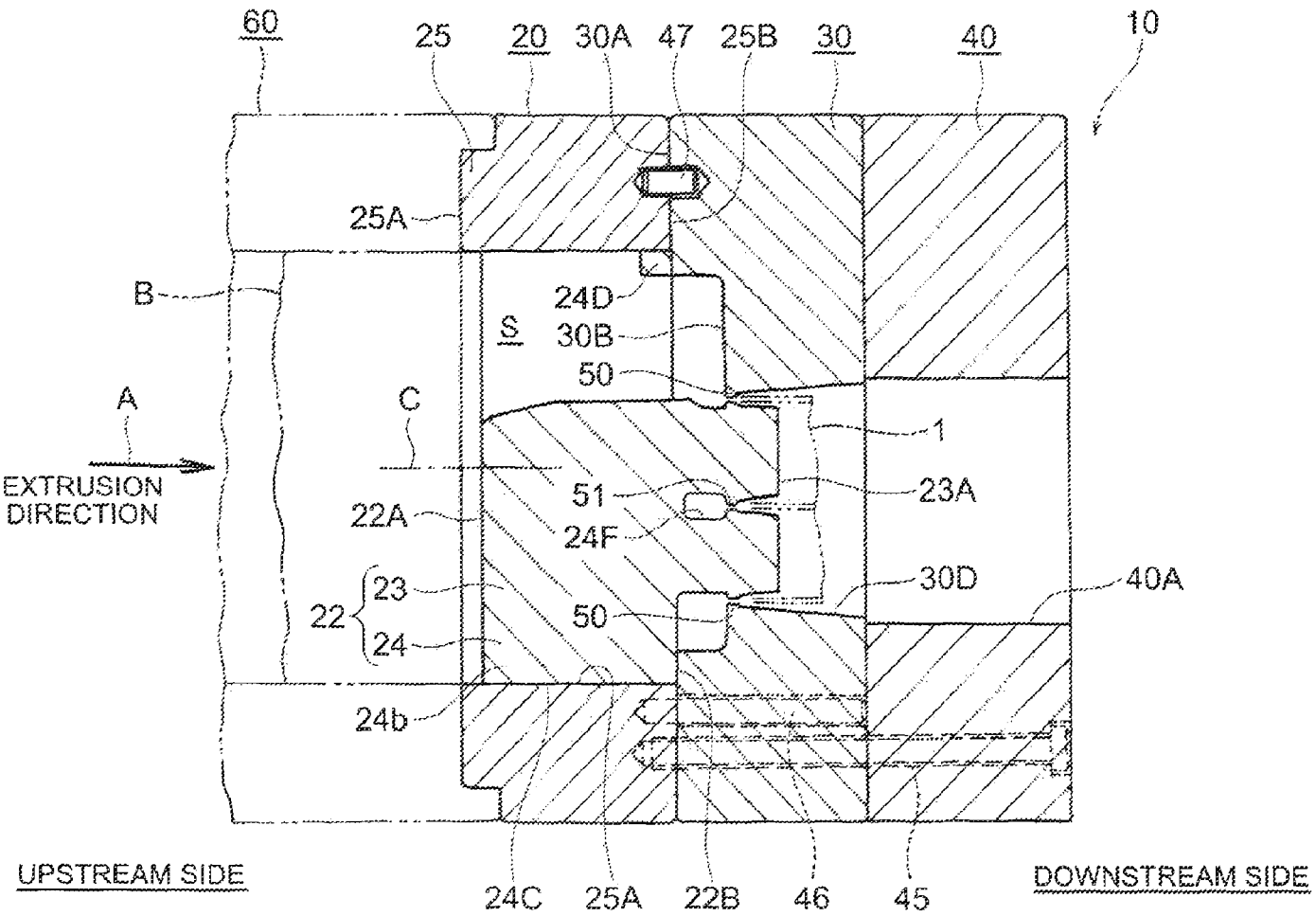
FIG. 2 is a vertical sectional view taken along a line II-II of FIG. 1.

As shown in FIG. 2, the extrusion die 10 is structured by including: a male die 20 which forms an inside shape of the hollow material 1 by protruding a billet B constituted with an aluminum alloy fed from the upstream side of the extrusion direction towards the downstream side; a female die 30 which forms an outside shape of the hollow material 1; and a back die 40 for holding the female die 30.

The billet B is housed inside a billet extrusion device 60 constituted with a chamber and the like disposed on the upstream side of the male die 20, and it is placed to be extruded out by the billet extrusion device 60.

The male die 20, the female die 30, and the back die 40 are connected in a unified manner.

Figure 1:
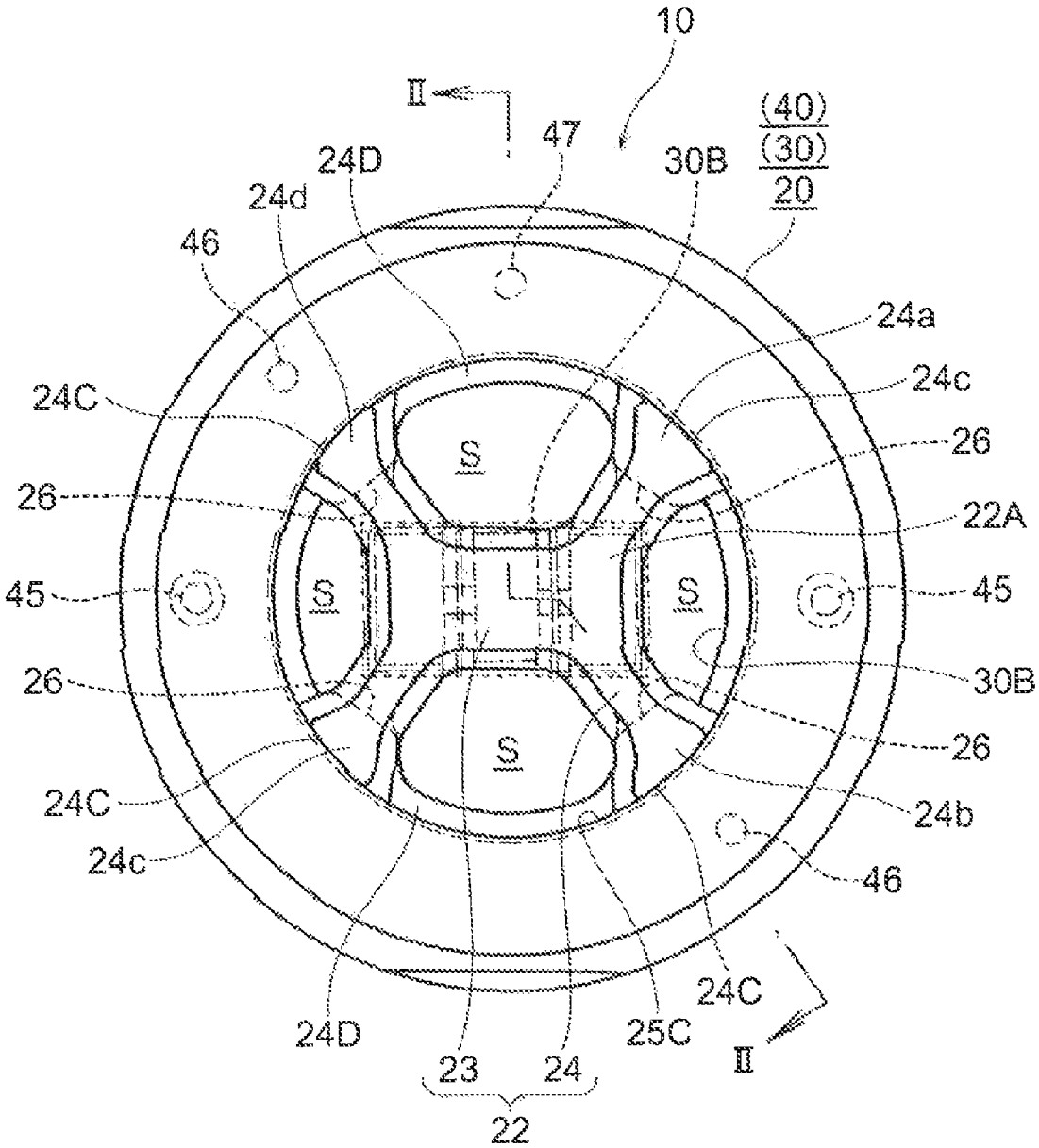
FIG. 1 is an overall plan view showing a first embodiment of an extrusion die for forming a hollow material according to the present invention.

That is, after the male die 20 and the female die 30 are positioned via a knock pin 47 and two positioning pins 46, for example, as shown in FIG. 1 and FIG. 2, the male die 20, the female die 30, and the back die 40 are connected and fixed via two connecting bolts 45, for example.

Figure 3:
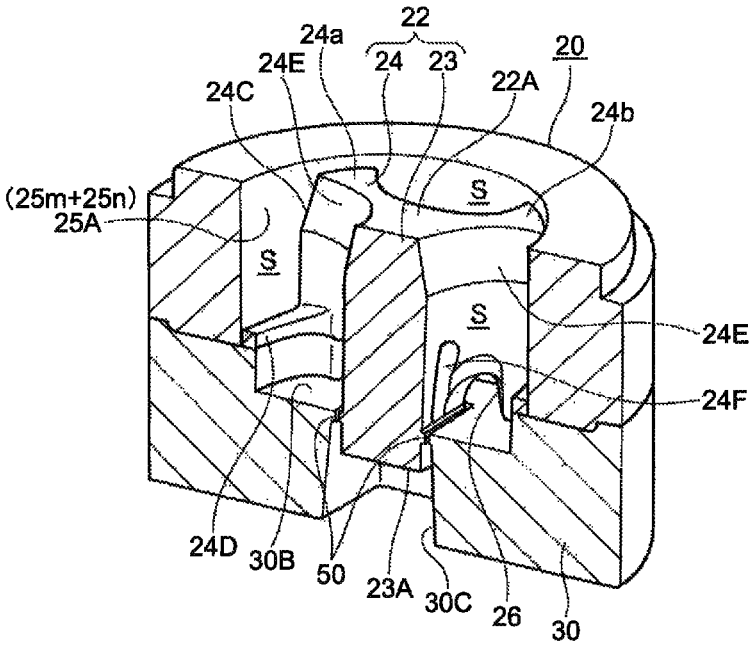
FIG. 3 is an overall sectional perspective view showing a state where a male die and a female die of the embodiment are combined.

As shown in FIG. 1 to FIG. 3, the male die 20 is constituted with a spider 22 for forming the inside shape of the hollow material 1 and a holder 25 for holding the outer periphery of the spider 22. The holder 25 and the spider 22 are strongly bonded and unified by shrink-fitting. Further, a top surface 22A of the spider 22 is formed as flat on the entire surface.

A mandrel 23 and the top surface 22A of a bridge part 24 constituting the spider 22 when the spider 22 and the holder 25 are assembled in a unified manner are located at positions recessed from a top end surface (seal surface) of the holder 25 towards the extrusion downstream side in a prescribed length as shown in FIG. 2.

The spider 22 is constituted with: the mandrel 23 which corresponds to the inside shape of the hollow material 1; and a plurality of bridge parts 24 which support the mandrel 23 and are projected in substantially X-letter shape towards the outer side from the periphery of the mandrel 23, i.e., four pieces including a first bridge part 24*a*, a second bridge part 24*b*, a third bridge part 24*c*, and a fourth bridge part 24*d*. Spaces between each of the bridge parts 24*a* to 24*d* are introduction spaces S for the billets B.

Further, each of distal-end outer peripheral surfaces 24C of those four pieces of the first bridge part 24*a*, the second bridge part 24*b*, the third bridge part 24*c*, and the fourth bridge part 24*d* is designed to be engaged with a bridge holding surface 25C that is the inner periphery part of the holder 25 and bonded by shrink-fitting.

A sloping billet guide surface 24E spreading wider towards the downstream side is formed in those first to fourth bridge parts 24*a* to 24*d* in a prescribed height from the top surface part 22A, so that the billets B extruded from the upstream side are extruded smoothly.

As described above, in the extrusion die 10 of the first embodiment, the distal-end outer peripheral surfaces 24C of the first bridge part 24*a*, the second bridge part 24*b*, the third bridge part 24*c*, and the fourth bridge part 24*d* and a part of the bridge holding surface 25C of the holder 25 constituting the spider 22 are strongly bonded by shrink-fitting.

Note here that shrink-fitting is a method for achieving strong bonding by using heat, and it is a fitting method with which a member such as a circular plate with holes are thermally expanded, shafts formed slightly larger than the diameter of the holes are fitted therein, and then cooled to be fixed. This method is used as fastening-type bonding. Then, the both (the circular plate and the shaft in the above case) are tightly fixed by shrink-fitting.

Any methods can be employed for applying heat at the time of shrink-fitting. However, it is preferable to apply heat by induction heating using a solid state power source, for example. This heating method is excellent in the reliability and reproducibility, so that high energy efficiency heating can be performed in a short period of time with no contact.

The state where the spider 22 and the holder 25 are bonded by shrink-fitting is shown in FIG. 2 and FIG. 3.

FIG. 2 and FIG. 3 show the state where the distal-end outer peripheral surface 24C of the second bridge 24*b*, for example, of the spider 22 and the bridge holding surface 25C of the holder 25 are strongly bonded by shrink-fitting. While the state where the distal-end outer peripheral surface 24C of the second bridge 24*b* and the bridge holding surface 25C of the holder 25 are strongly bonded is shown in FIG. 2 and FIG. 3, the bonded state of the respective distal-end outer peripheral surface 24C of the other first bridge part 24*a*, the third bridge part 24*c*, and the fourth bridge part 24*d* and the bridge holding surface 25C of the holder 25 is the same as the state shown in FIG. 2 and FIG. 3.

Figure 4:
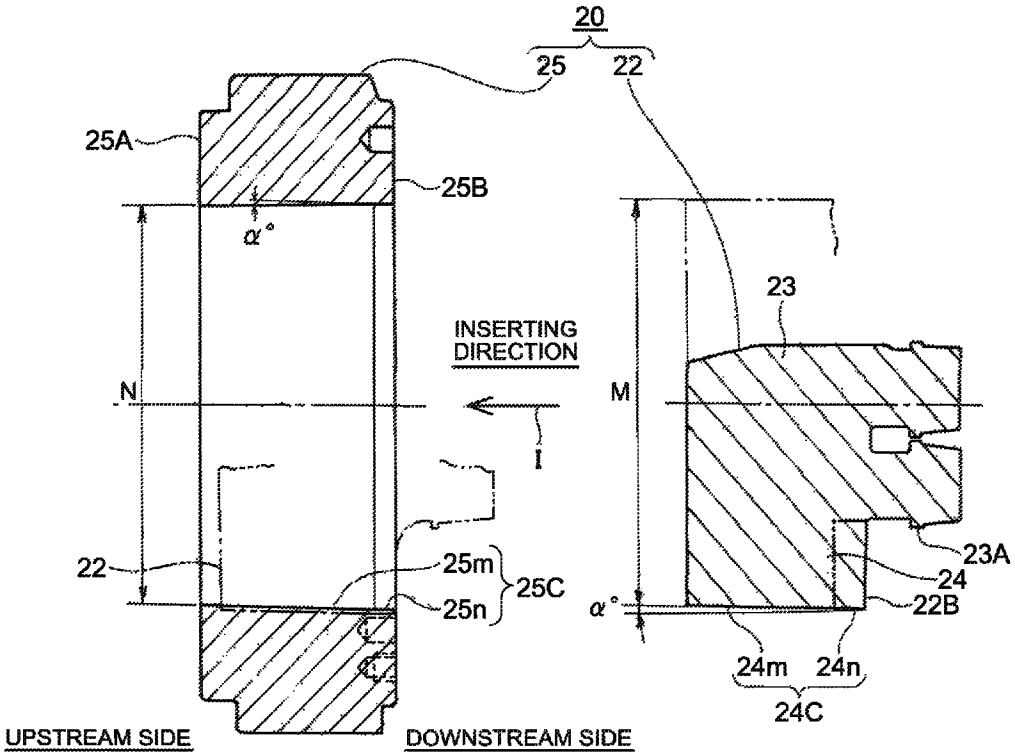
FIG. 4 is a fragmented sectional view showing a state before a holder and a spider of the embodiment are shrink-fitted.

FIG. 4 shows a state before the spider 22 and the holder 25 are shrink-fitted. FIG. 4 is a view showing a state where the male die 30 of FIG. 2 which shows a vertical sectional view taken along a line II-II of FIG. 1 is expanded while the spider 22 and the holder 25 are decomposed.

The holder 25 is formed in an overall circular plate in a prescribed thickness. The bridge holding surface 25C thereof is formed with a sloping surface part 25*m* that is formed at a prescribed sloping angle α degree spreading from the distal-end inside diameter end part of the top end surface 25A of the holder 25 towards the female die 30 side and a straight line part 24*n* extended out straight to the bottom surface 25B continuously from the distal-end of the sloping surface part 25*m*.

Further, the sloping angle α degree of the slope surface part 25*m* is set as 0.5 degree to 1 degree, for example.

Furthermore, the inside diameter N of the distal-end inside diameter end part on the top end surface 25A of the slope surface part 25*m* constituting the bridge holding surface 25C is the inside diameter before performing shrink-fitting, i.e., before the holder 25 is heated.

In the meantime, the distal-end outer peripheral surface 24C of the second bridge part 24*b* of the spider 22 is formed to correspond to the bridge holding surface 25C.

That is, the distal-end outer peripheral surface 24C of the spider 22 is formed with a sloping surface part 24*m* that is formed at a prescribed sloping angle α degree spreading from the outer periphery end part of the top end surface 22A towards the female die 30 side and a straight line part 24*n* extended out straight to the distal end of the slope surface part 24*m* continuously. Further, the slope surface part 24*m* is structured to correspond to the slope surface part 25*m* of the bridge holding surface 25C, and the straight line part 24*n* is structured to correspond to the straight line part 25*n* of the bridge holding surface 25C.

Further, the sloping angle α degree of the slope surface part 24*m* is set as 0.5 degree to 1 degree same as the sloping angle α degree of the slope surface part 25*m* of the bridge holding surface 25C.

As described above, the slope surface part 25*m* and the slope surface part 24*m* corresponding to each other are formed in the bridge holding surface 25C of the holder 25 and the distal-end outer peripheral surface 24C of the spider 22, respectively. Thus, the slope surface part 24*m* comes in a state of being guided to the slope surface part 25*m* when the spider 22 is inserted into the holder 25, so that insertion work can be done easily.

However, when the entire surface is a slope surface, a force in an inverted direction of the insertion direction, i.e., a force for slipping out the spider 22 from the holder 25, is generated since the slope surface part 25*m* and the slope surface part 24*m* are sloping with respect to each other.

Thus, in order to prevent the spider 22 from being slipped out from the holder 25, the straight line part 25*n* and the straight line part 24*n* are provided, respectively, in the distal-end parts of each of the slope surface part 25*m* and the slope surface part 24*m* in the first embodiment. Therefore, there is a frictional force generated between the straight line part 25*n* and the straight line part 24*n*, so that it is possible to prevent the spider 22 from being slipped out from the holder 25.

The external size of the spider 22, i.e., a circumcircle to which the distal-ends of the first to fourth bridge parts 24*a* to 24*d* come in contact, is set as an external size M. This external size M is formed larger by a prescribed amount than the inside diameter size of the bridge holding surface 25C of the holder 25 before being heated.

In other words, the distal-end inside diameter size N of the bridge holding surface 25C of the holder 25 before being heated is formed to be in a smaller size than the outside diameter size M of the circumcircle of each of the distal-end outer peripheral surfaces 24C of the first to fourth bridge parts 24*a* to 24*d* of the spider 22.

Figure 5:
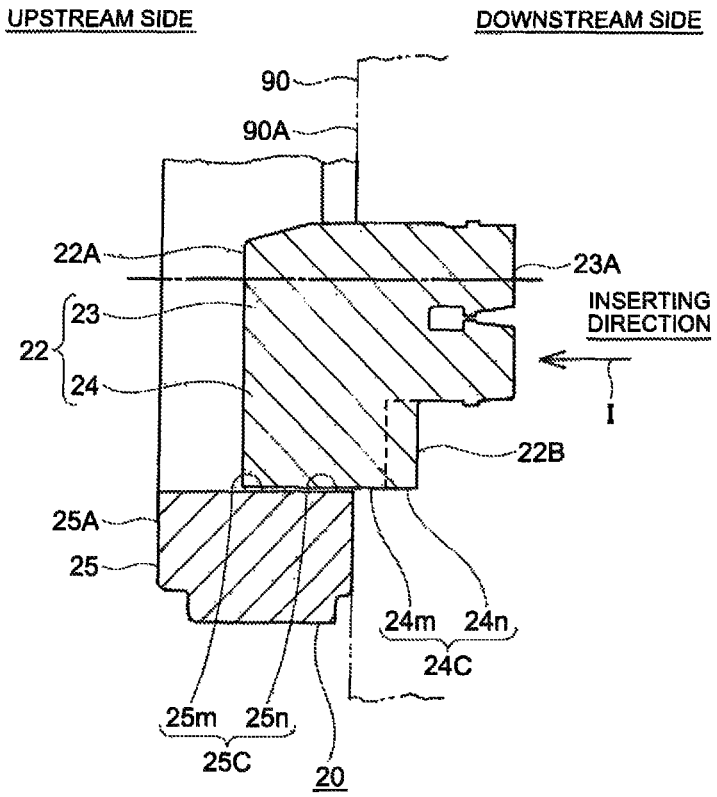
FIG. 5 is a sectional view showing a state where the spider is inserted into the holder that is heated when shrink-fitting the holder and the spider of the embodiment.

The sizes of the spider 22 and the holder 25 are set in the manner described above. Thus, at the time of shrink-fitting, as shown in FIG. 5, first, the holder 25 is heated to expand the bridge holding surface 25C of the holder 25 to expand the inside diameter size N of the distal-end inside diameter end part of the bridge holding surface 25C to be wider than the outside diameter size M of the spider 22. Then, while grasping the spider 22 by a spider grasping module, not shown, the first to fourth bridge parts 24*a* to 24*d* are inserted to the bridge holding surface 25C of the holder 25 along the insertion direction of the spider 22 shown with an arrow 1 in FIG. 4 and FIG. 5, i.e., from the downstream side towards the upstream side.

Then, the fitted state of the both at accurate positions and the like is checked and then cooling is done thereon. Thereby, the bridge holding surface 25C of the holder 25 is returned to the inside diameter size N that is in the state before being heated. Therefore, each of the distal-end external peripheral surfaces 24C of the first to fourth bridge parts 24*a* to 24*d* is strongly bonded to the holder 25. As a result, the spider 22 and the holder 25 are unified in a tightly fixed state.

In FIG. 4, the spider 22 is illustrated in the holder 25 with an imaginary line (a two-dot chain line). This FIG. 4 shows the size of the spider 22 in a case of a state where the holder 25 is not heated.

In practice, as shown in FIG. 5, the holder 25 is heated to expand the bridge holding surface 25C of the holder 25 to extend the inside diameter size N of the distal-end inside diameter end part of the bridge holding surface 25C to be wider than the external size of the circumcircle of each of the distal-end outer peripheral surfaces 24C of the first to fourth bridge parts 24*a* to 24*d* and cooled thereafter, so that the inside diameter size of the bridge holding surface 25C of the holder 25 after being shrink-fitted becomes the same size as the external size M of the circumcircle of the first to fourth bridge parts 24*a* to 24*d*.

Note here that the shrink-fitting work of the spider 22 and the holder 25 can be done by placing the holder 25 on a shrink-fitting worktable 90, for example, as shown in FIG. 5.

In this case, the positioning of the spider 22 and the holder 25 in the thickness direction can be done by abutting a bottom surface part 22B of the spider 22 to a top end surface 90A of the shrink-fitting worktable 90.

When the spider 22 is inserted into the inner peripheral surface of the heated holder 25 and then cooled at the time of performing shrink-fitting, the first to fourth bridge parts 24*a* to 24*d* constituting the spider 22 tend to be deformed in a contracting direction.

Thus, the first embodiment is structured to provide a bridge horizontal shaking prevention part 24D in a part of the distal-ends of the two bridge parts 24 opposing to each other at the side surfaces on the downstream side so that the first to fourth bridge parts 24*a* to 24*d* are not deformed in a contracting direction.

Figure 6:
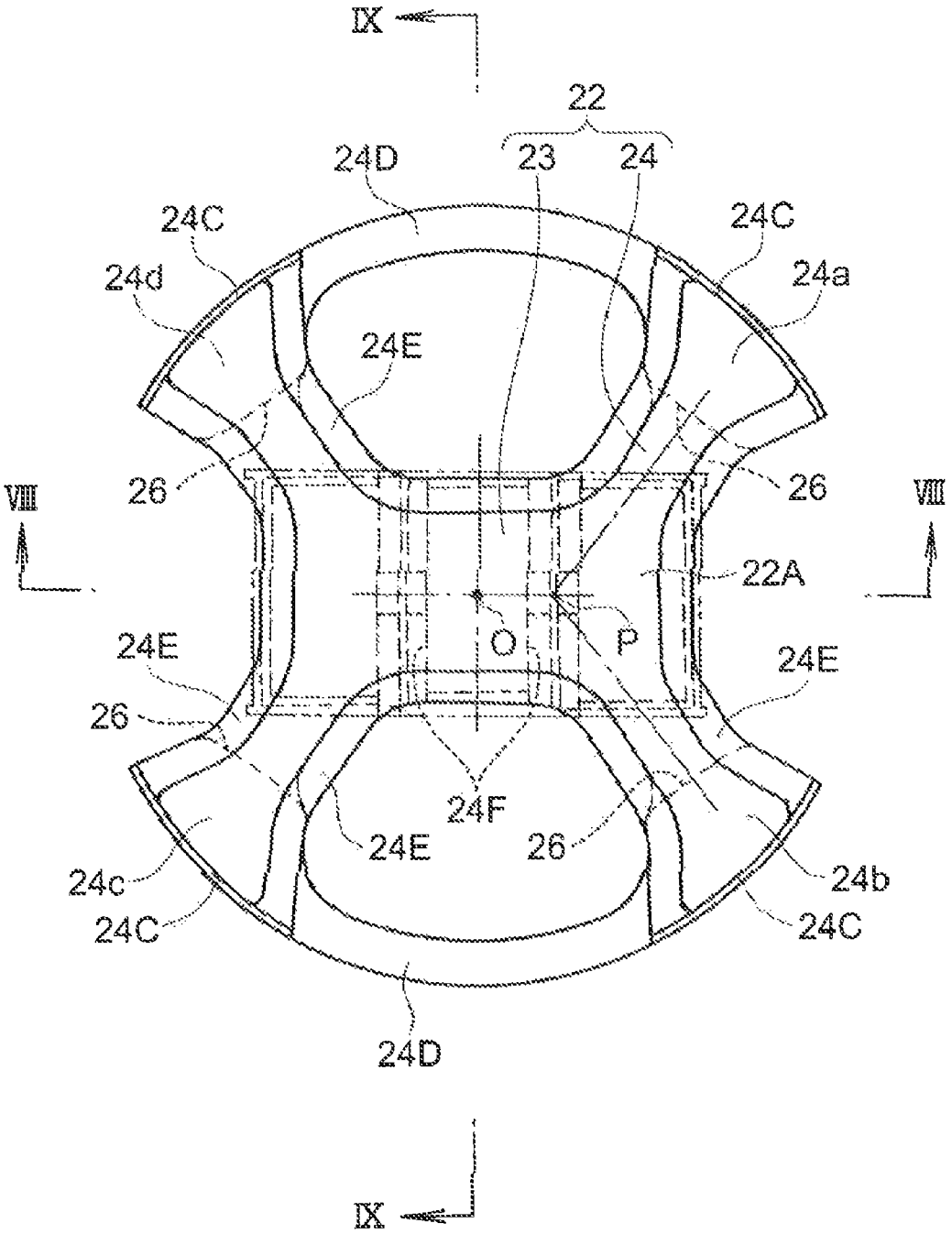
FIG. 6 is a plan view showing a plan view of the spider of the embodiment.
Figure 7:
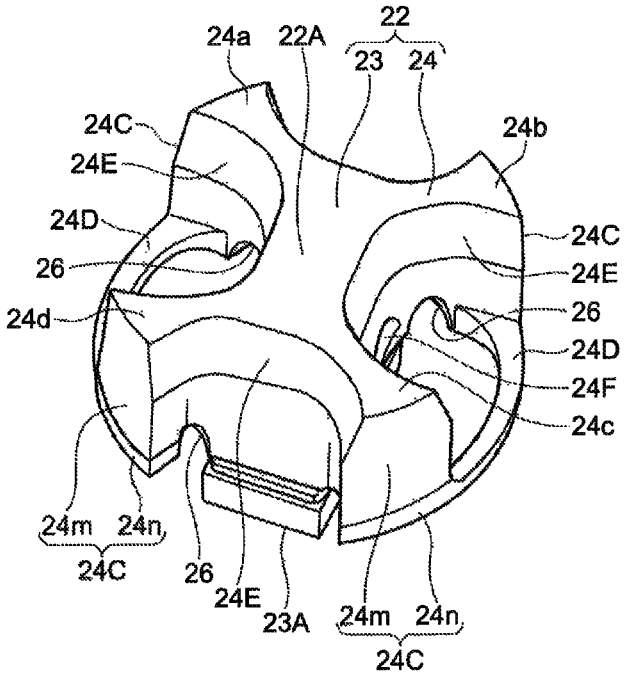
FIG. 7 is an overall perspective view showing the spider of the embodiment.

That is, as shown in FIG. 6 and FIG. 7, the above-described bridge horizontal shaking prevention part 24D is provided in a part of the distal-ends of the first bridge part 24*a* and the fourth bridge part 24*d* as well as the second bridge part 24*b* and the third bridge part 24*c* at the side surfaces on the downstream side of the opposing to each other among the first to fourth bridge parts 24*a* to 24*d* disposed to be in an X-letter shape on a plan view. Thus, the bridge horizontal shaking prevention part 24D is provided at two points on the opposite sides from each other by sandwiching the mandrel 23.

The bridge horizontal shaking prevention part 24D is formed in substantially the same height as the height of the straight line part 24*n* of the distal-end outer peripheral surface 24C of the first to fourth bridge parts 24*a* to 24*d*. Further, the bridge horizontal shaking prevention part 24D is formed in a straight line form that is in parallel to the straight line part 24*n* of the distal-end outer peripheral surface 24C.

Furthermore, the bridge horizontal shaking prevention part 24D is placed on the edge part that forms a billet pool part 30B to be described in details later (see FIG. 2).

The first to fourth bridge parts 24*a* to 24*d* are placed in substantially an X-letter shape on a plan view as described above continuously with the mandrel 23. As shown in FIG. 6, the intersection point P connecting the centers in the width direction of each of the bridge parts 24*a* to 24*d* is at a position different from the center O of the spider 22 and the X-letter shape is a deformed X-letter shape. Thus, the distances between the first bridge part 24*a* and the fourth bridge part 24*d* and between the second bridge part 24*b* and the third bridge part 24*c* are different by a prescribed amount with respect to the distances between the first bridge part 24*a* and the second bridge part 24*b* and between the third bridge part 24*c* and the fourth bridge part 24*d*.

In this embodiment, the distance between the first bridge part 24*a* and the fourth bridge part 24*d* is longer than the distance between the first bridge part 24*a* and the second bridge part 24*b*.

When the distance between the neighboring bridge parts among the first to fourth bridge parts 24*a* to 24*d* is longer, the shape tends to be deformed, i.e., tends to be contracted. Thus, in the embodiment, the bridge horizontal shaking prevention part 24D is provided between the first bridge part 24*a* and the fourth bridge part 24*d* and between the second bridge part 24*b* and the third bridge part 24*c*, respectively, where the distances between the neighboring bridges are longer.

The spider 22 and the holder 25 are structured in the manner described above. Thus, when the spider 22 is inserted into the bridge holding ace 25C of the heated holder 25 and the spider 22 is pushed in while being turned for fixing the first to fourth bridge parts 24*a* to 24*d* at prescribed positions at the time of shrink-fitting, deformation of the first to fourth bridge parts 24*a* to 24*d* can be prevented since the bridge horizontal shaking prevention part 24D is provided between the first bridge part 24*a* and the fourth bridge part 24*d* and between the second bridge part 24*b* and the third bridge part 24*c*, respectively, and the bridge horizontal shaking prevention parts 24D hold the side surface parts of each of the bridge parts 24*a* and 24*d* in a mutually pressing state.

As shown in FIG. 1, FIG. 3, and the like, space connecting holes 26 connecting between the billet introduction spaces S formed between each of the bridge parts 24*a* to 24*d* are formed in the lower parts of each of the bridge parts 24*a* to 24*d*. Therefore, after the billet B fed from the upstream side is introduced into the billet introduction space S, the billet B is mixed with the billet B inside the billet introduction space S neighboring to each other via the space connecting hole 26.

Figure 8:
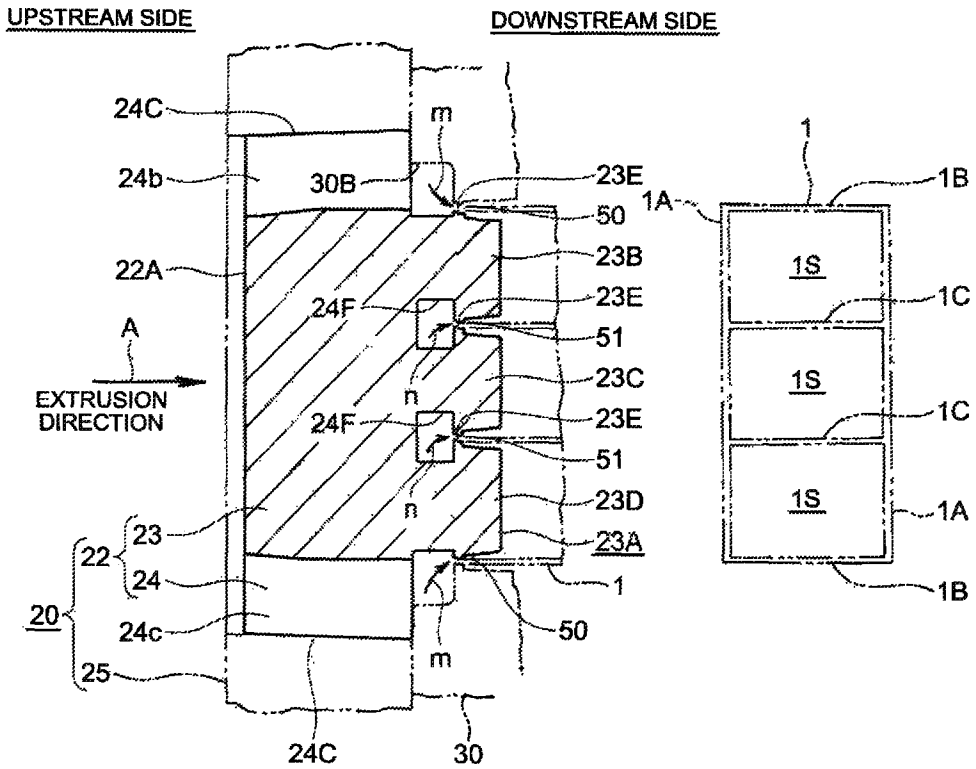
FIG. 8 is a vertical sectional view taken along a line VIII-VIII of FIG. 6.

As shown in FIG. 2, FIG. 3, FIG. 8, and the like, an inside forming projected part 23A formed on the downstream side end part of the flow of the billet B is provided in the mandrel 23 which constitutes the spider 22.

The inside forming projected part 23A is formed by being projected on the female die 30 side from the bottom end of the distal-end outer peripheral surfaces 24C of each of the bridge parts 24*a* to 24*d*. Further, such inside forming projected part 23A is constituted with a first inside piece part 23B, a second inside piece part 23C, and a third inside piece part 23D which form three spaces 1S, 1S, and 1S, of the hollow material 1 in a sectional shape having a rectangle with two vertically parallel lines, respectively, as shown with a virtual image (a two-dot chain line) in FIG. 8.

Figure 9:
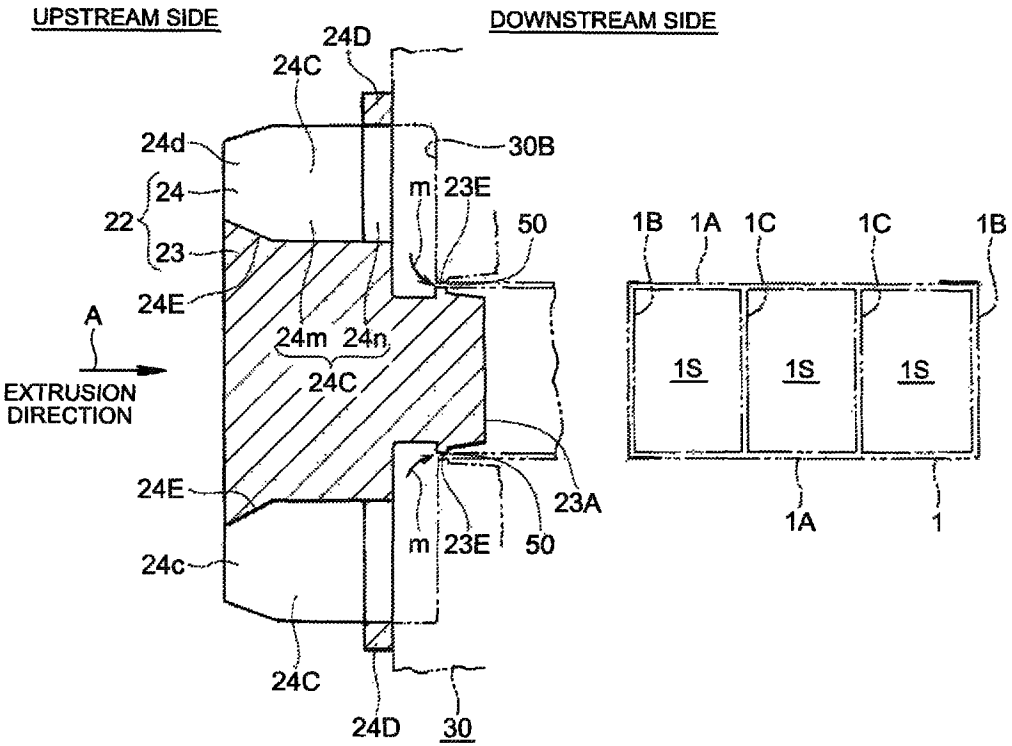
FIG. 9 is a vertical sectional view taken along a line IX-IX of FIG. 6.

Note here that the hollow material 1 in a sectional shape having a rectangle with two vertically parallel lines is in a shape having a pair of long walls 1A, 1A, short walls 1B, 1B which connect the longitudinal-direction end parts of the long walls 1A, 1A to each other, and two partition walls 1C, 1C disposed equivalently between the short walls 1B and 1B as shown with a virtual line in FIG. 8 and FIG. 9.

The inside forming projected part 23A is projected out from the bottom ends of the distal-end outer peripheral surfaces 24C of each of the bridge parts 24*a* to 24*d* towards the female die 30 side as described above. This inside forming projected part 23A is inserted into the billet pool part 30B formed in the female die 30 and into a material forming hole part 50 continued therefrom as shown in FIG. 2.

Further, the billet pool part 30B is formed to have an inside diameter that is substantially equivalent to the size of the inside diameter of the bridge horizontal shaking prevention part 24D and to have a prescribed depth as shown in FIG. 2.

Figure 10:
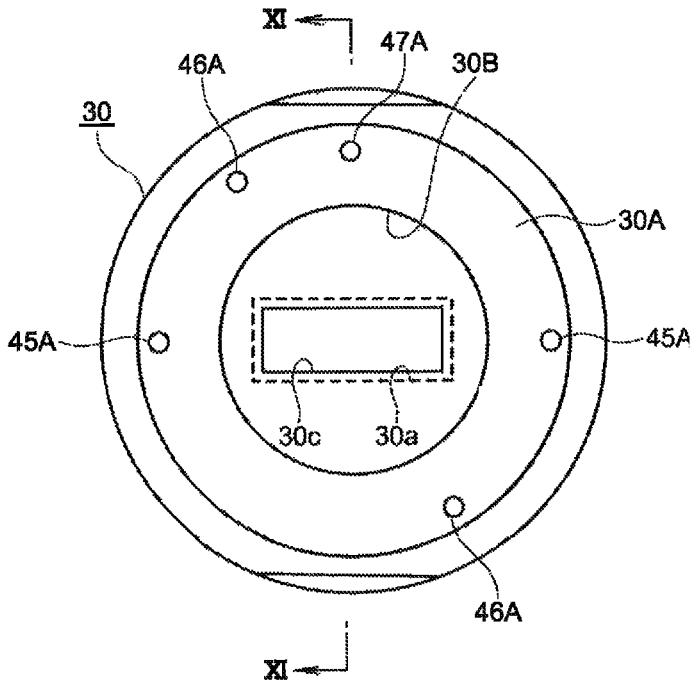
FIG. 10 is an overall plan view showing the female die of the embodiment.
Figure 11:
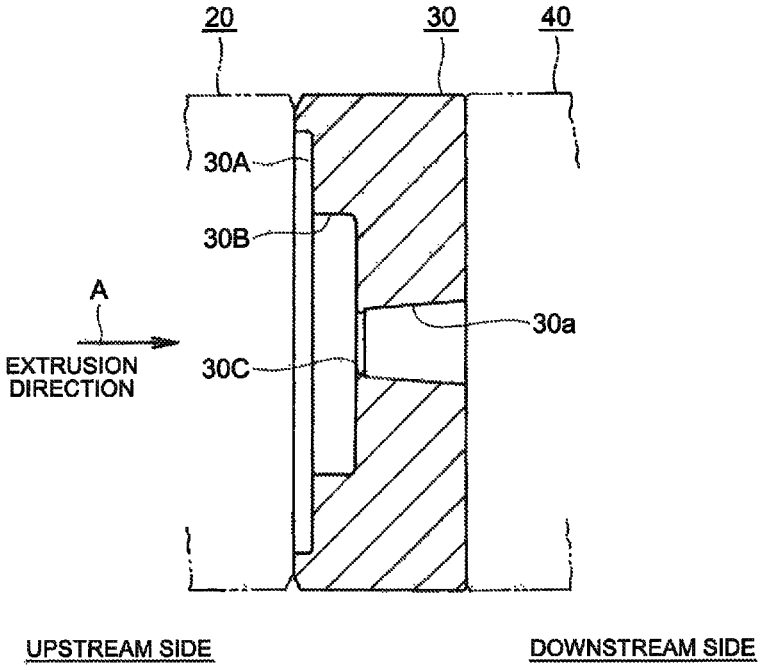
FIG. 11 is a vertical sectional view taken along a line XI-XI of FIG. 10.

As shown in FIG. 10 and FIG. 11, a holder receiving surface 30A whose center part is recessed is formed on the top surface (the surface on the upstream side) of the female die 30, so that the bottom surface 25B of the holder 25 can be abutted against the holder receiving surface 30A to hold the holder 25.

Further, the billet pool part 30B is formed on the holder receiving surface 30A.

The material forming hole part 50 is formed substantially in the center part of the billet pool part 30B, and it is formed with a prescribed sized space set between the outer shape of the inside forming projected part 23A and an outside forming aperture part 30C formed in the billet pool part 30B. Further, the outside shape of the hollow material 1 shown with a virtual line (a two-dotted chain line) in FIG. 8 and FIG. 9 is formed with the billet B extruded out from the material forming hole part 50.

As shown in FIG. 11, the outside forming aperture part 30C includes a clearance part 30*a* expanded from a small-sized straight line part to the outer periphery direction of the female die 30.

Thus, the billet B extruded out from the material forming hole part 50 is extruded without making a contact to the surrounding part at all.

Each of the first inside piece part 23B, the second inside piece part 23C, and the third inside piece part 23D constituting the inside forming projected part 23A is formed substantially in a quadrangular prism shape, and provided at the end part of the extrusion direction downstream side of the mandrel 23 as described above.

On the extrusion direction upstream side in each of the piece parts 23B, 23C, and 23D, a band-like projected frame 23E projected outside from the outer periphery of each of those is provided to be wrapped around each of the piece parts 23B, 23C, and 23D, respectively.

The projected frames 23E at the three points in the outer periphery of the first inside piece part 23B and the third inside piece part 23D and the projected frames 23E at the two points in the outer periphery of the second inside piece part 23C are opposing to the material shape forming aperture 30C of the female die 30, respectively, and each of the gaps constitutes the material forming hole part 50 for forming the long side walls 1A, 1A and the short side walls 1B, 1B.

Further, the long side walls 1A, 1A and the short side walls 1B, 1B of the hollow material 1 are formed by the billets B extruded out from the material forming hole parts 50.

Further, the gap between the projected frame 23E of the first piece part 23B and the projected frame 23E of the second piece part 23C opposing to each other and the gap between the projected frame 23E of the second piece part 23C and the projected frame 23E of the third piece part 23D opposing to each other constitute the material forming hole parts 51 for forming the partition walls 1C, 1C.

Further, the partition walls 1C and 1C of the hollow material 1 are formed by the billets B extruded out from the material forming hole parts 51.

A billet guide hole part 24F is provided in a connected manner, respectively, to the gap between the projected frame 23E of the first piece part 23B and the projected frame 23E of the second piece part 23C and to the gap between the projected frame 23E of the second piece part 23C and the projected frame 23E of the third piece part 23D, respectively.

As shown with a dotted line in FIG. 6, the billet guide hole part 24F is formed along the direction of the line connecting the first bridge part 24*a* to the second bridge part 24*b* and the third bridge part 24*c* to the fourth bridge part 24*d*, and it is formed substantially in a rectangular tunnel shape as shown in FIG. 8.

Further, the billet B is pressed and guided into the billet guide hole part 24F as shown in an arrow n from the billet introduction space S and extruded out via the material forming hole part 51.

Furthermore, the billet B is pressed and guided as shown with an arrow m from the billet introduction space S to the gap between the projected frames 23E of the first inside piece part 23B and the third inside piece part 23D and the material external shape aperture part 30C of the female die 30, i.e., to the material forming hole part 50, and extruded out via the material forming hole part 50.

The hollow material 1 extruded and formed by the die 10 constituted in the manner described above is shown in FIG. 12.

That is, as shown in FIG. 12, the above-described hollow material 1 is in a sectional shape having a rectangle with two vertically parallel lines in which both ends of a pair of long side parts 1A are connected by the short sides 1B, two partition walls 1C are formed by connecting between the pair of long sides 1A between those short side parts 1B, so that there are three spaces 1S, 1S, and 1S formed inside thereof.

Further, such hollow material 1 in a sectional shape having a rectangle with two vertically parallel lines is continuously extrusion-formed from the material forming hole parts 50 and 51 of the extrusion die 10 by corresponding to the supply amount of the billet B.

Next, a method for forming the hollow material 1 by using the extrusion die 10 in the above-described structure will be described.

When the billet B is extruded out from the billet extrusion device 60 provided on the upstream side of the extrusion direction of the billet B for the male die 20, the billet B first is introduced into the billet introduction spaces S constituted by the gaps between each of bridge parts 24*a* to 24*d* constituting the spider 22 and the holder 25 from the entrance of the bridge holding surface 25C of the holder 25.

The billets B introduced into the billet introduction spaces S are guided into the material forming hole part 50 via each of the billet guide surfaces 24E of the first to fourth bridge parts 24*a* to 24*d* and the side surface of the mandrel 23, and then extrusion-formed from the material forming hole parts 50, 51.

Then, the extrusion-formed hollow material 1 is fed out from a material send-out hole 40A formed in the back die 40 and, thereafter, transported to a prescribed stockyard or the like by being held by a holding mechanism, not shown.

The extrusion die 10 according to the embodiment is structured in the manner described above, so that following effects can be acquired.

(1) The engaged surfaces between the distal-end outer peripheral surfaces 24C of the first to fourth bridge parts 24*a* to 24*d* of the bridge part 24 constituting the spider 22 and the bridge holding surface 25C of the holder 25 are unified by being strongly bonded by shrink-fitting, so that the stress imposed upon the die can be received by the spider 22 and the holder 25. Thereby, the stress imposed upon the stress concentrated parts in each of the bridge parts 24*a* to 24*d* can be eased, so that breakage of the bridge part 24 of the spider 22 can be prevented. As a result, it becomes possible to perform high-speed extrusion and to extend the life even when extrusion-forming the billet B constituted with a high-strength alloy with a high extrusion processing force, particularly constituted with the so-called 7000-system maximum strength aluminum alloy.

(2) Even when the pressure for extruding the billet B is applied to the mandrel 23 and each of the bridge parts 24*a* to 24*d* of the spider 22, each of the bridge parts 24*a* to 24*d* alone of the spider 22 is not slightly shifted and is held stably since the distal-end outer peripheral surfaces of each of the bridge parts 24*a* to 24*d* of the spider 22 and the bridge holding surface 25C of the holder 25 are bonded and unified by shrink-fitting. As a result, it becomes possible to process the hollow material 1 with a desired high precision.

(3) Each of the distal-end outer peripheral surfaces 24C of the first to fourth bridge parts 24*a* to 24*d* is formed with the slope surface part 24*m* and the straight line part 24*n*, and the bridge holding surface 25C of the holder 25 is formed with the slope surface part 25*m* and the straight line part 25*n*. Thus, after the spider 22 is inserted into the holder 25, the bridge holding surface 25C is contracted when being cooled. Therefore, a force for pushing out the spider 22 in the push-out direction works. However, there is a friction force generated between the respective straight line parts 25*n* and 24*n*, so that it is possible to prevent the spider 22 from being slipped out from the holder 25.

(4) Each of the distal-end outer peripheral surfaces 24C of the first to fourth bridge parts 24*a* to 24*d* is formed with the slope surface part 24*m* and the straight line part 24*n*, and the bridge holding surface 25C of the holder 25 is formed with the slope surface part 25*m* and the straight line part 25*n*. Thus, the slope surface part 24*m* comes in a state of being guided to the slope surface part 25*m* when the spider 22 is inserted into the holder 25, so that insertion work can be done easily. As a result, it becomes easy to do the shrink-fitting work, so that the operability can be improved.

(5) The sloping guide surface 24E in a prescribed height gradually widened from the top face part 22A of each of the bridge parts 24*a* to 24*d* is formed in the mandrel 23 and the first to fourth bridge parts 24*a* to 24*d* of the spider 22 over a prescribed height. Thus, the billets B extruded from the upstream side can be smoothly extruded out into the billet introduction spaces S. As a result, the billets B can flow equivalently, so that the uniform hollow material 1 can be formed.

(6) Among the first to fourth bridge parts 24*a* to 24*d*, those with a longer distance between the neighboring bridges tend to be deformed easily. However, the bridge horizontal shaking prevention part 24D is provided, respectively, between the first bridge part 24*a* and the fourth bridge part 24*d* as well as between the second bridge part 24*b* and the third bridge part 24*c*, and the bridge horizontal shaking prevention part 24D holds them by pressing against the side surface parts of each of the bridge parts 24*a*, 24*d*, and the like. Therefore, it is possible to prevent deformation of the first to fourth bridge parts 24*a* to 24*d*.

Next, a second embodiment of the extrusion die according to the present invention will be described by referring to FIG. 14 to FIG. 16.

An extrusion die 10A according to the second embodiment is provided with: first to fourth bridge parts 74*a* to 74*d* corresponding to the distal-end outer peripheral surfaces 24C of the first to fourth bridge parts 24*a* to 24*d* of the extrusion die 10 according to the first embodiment; and an uneven structure 77 as well as a step structure 78 over a distal-end outer peripheral surface 74C and a bridge holding surface 75C of a holder 75.

In the second embodiment, only the uneven structure 77 and the step structure 78 are different from the first embodiment and other structures are completely the same. Thus, same reference numerals are applied to the same structures and same members, and only the different points will be described.

Figure 14:
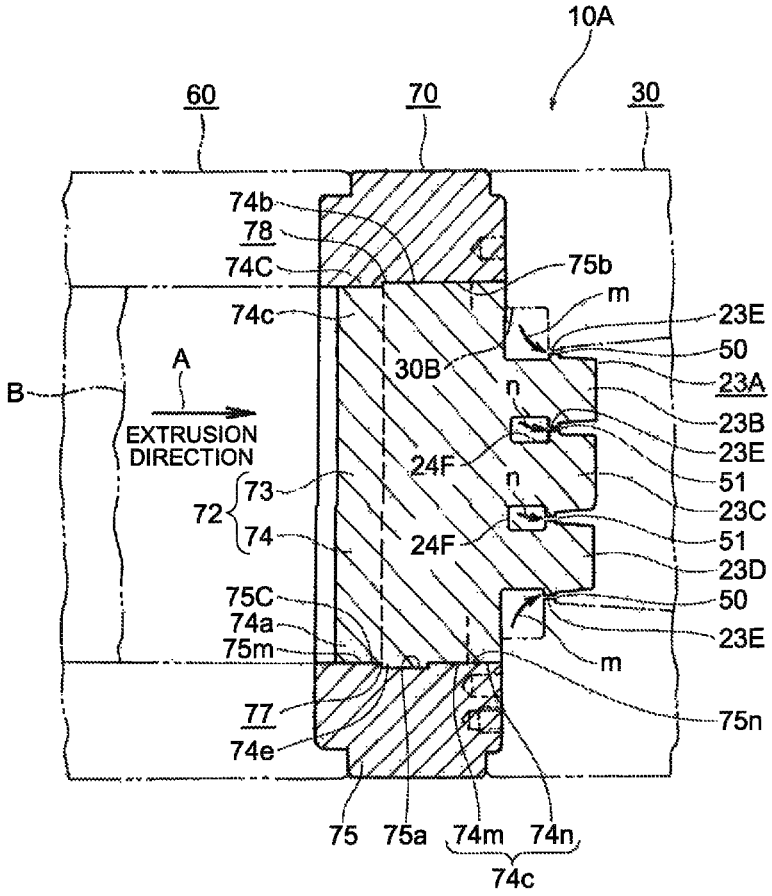
FIG. 14 shows a second embodiment of the hollow material forming extrusion die according to the present invention, which is a vertical sectional view showing a state where a holder and a spider are unified by shrink-fitting taken along a line XIV-XIV of FIG. 15.
Figure 15:
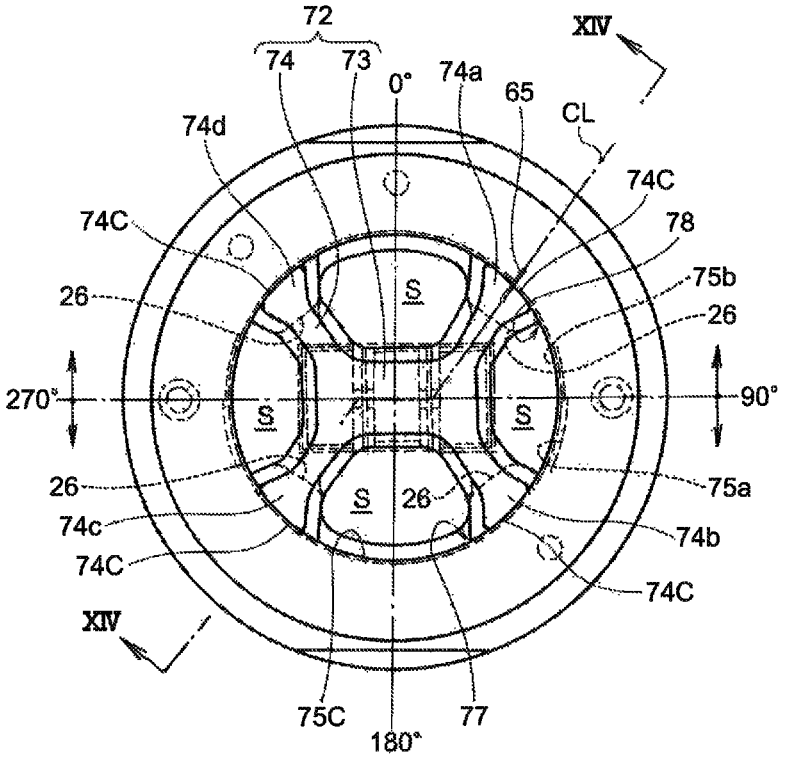
FIG. 15 is a plan view showing a state of positioning when shrink-fitting the holder and the spider of the second embodiment.

As shown in FIG. 14 and FIG. 15, the extrusion die 10A of the second embodiment is structured by including a male die 70 which corresponds to the male die 20. Further, the male die 70 is structured by including a spider 72 corresponding to the spider 22 and a holder 75 corresponding to the holder 25.

As shown in FIG. 14 and FIG. 15, the spider 72 is structured with: a mandrel 73 corresponding to the mandrel 23; and a plurality of bridge parts 74 which support the mandrel 73 and are projected in substantially X-letter shape towards the outer side from the periphery of the mandrel 73, i.e., four pieces including a first bridge part 74*a*, a second bridge part 74*b*, a third bridge part 74*c*, and a fourth bridge part 74*d*.

Further, the distal-end outer peripheral surfaces 74C of the first bridge part 74*a*, the second bridge part 74*b*, the third bridge part 74*c*, and the fourth bridge part 74*d* are designed to be engaged with a bridge holding surface part 75C of the holder 75, and each of the distal-end outer peripheral surfaces 74C of the first to fourth bridge parts 74*a* to 74*d* and the bridge holding surface part 75C of the holder 75 are bonded by shrink-fitting.

The uneven structure 77 is constituted with: a protruded surface part 74*e* provided on each of the distal-end outer peripheral parts 74C of the first bridge part 74*a* and the fourth bridge part 74*d*; and a recessed surface part 75*a* which is formed in the bridge holding surface part 75C of the holder 75 to correspond to the protruded surface part 74*e*.

The bridge holding surface part 75C corresponds to the bridge holding surface part 25C of the first embodiment, and it is formed with a slope surface part 75*m* and a straight line part 75*n* as in the case of the bridge holding surface part 25C. Further, in the bridge holding surface part 75C of the holder 75, the recessed surface parts 75*a* corresponding to the respective projected surface parts 74*e* of the two bridge parts 74*a* and 74*d* are formed at positions somewhere on the slope surface part 75*m*.

Furthermore, the distal-end outer peripheral surface part 74C corresponds to the distal-end outer peripheral surface 24C of the first embodiment, and it is formed with a slope surface part 74*m* and a straight line part 74*n* as in the case of the distal-end outer peripheral surface 24C, and the projected surface part 74*e* is formed at a position somewhere on the slope surface part 74*m*.

Further, the step structure 78 is constituted with: a step surface part 74*f* provided in each of the distal-end outer peripheral surface parts 74C of the second bridge part 74*b* and the third bridge part 74*c*; and a step receiving surface part 75*b* which is formed in the bridge holding surface part 75C of the holder 75 to correspond to the step surface part 74*f*. The step receiving surface part 75*b* is formed in a straight line surface.

As shown in FIG. 15, the recessed surface part 75C of the holder 75 which constitutes the uneven structure 77 is formed in a lower half part of the area acquired by connecting the point at 90 degrees and the point at 270 degrees, for example, on a plan view of the male die 70. Further, the step receiving surface part 75*b* of the holder 75 which constitutes the step structure 78 is formed in an upper half part of the area acquired by connecting the point at 90 degrees and the point at 270 degrees.

Therefore, when shrink-fitting the spider 72 and the holder 75, it is necessary to insert and position the first bridge part 74*a* and the fourth bridge part 74*d* to be located at the lower half part sectioned by the line connecting between the point at 90 degrees and the point at 270 degrees in FIG. 15 and to insert and position the second bridge part 74*b* and the third bridge part 74*c* to be located at the upper half part sectioned by the line connecting between the point at 90 degrees and the point at 270 degrees in FIG. 15.

Further, in the embodiment, a position check mark 65 is applied to the spider 72 and the holder 75 for checking that each of the bridge parts 74*a* to 74*d* is disposed within the above-described range.

Figure 16:
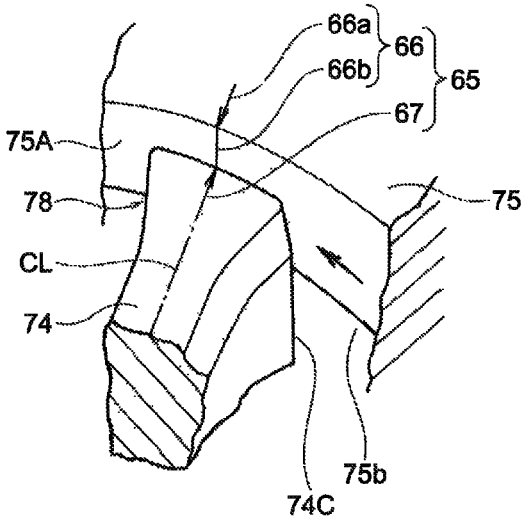
FIG. 16 is a perspective view showing a state of positioning when shrink-fitting the holder and the spider of the second embodiment.

That is, the position check mark 65 is constituted with: a fixed side mark 66 applied to the holder 75; and a moving side mark 67 applied to the first bridge part 74*a* which constitutes the bridge part 74 of the spider 72 as shown in FIG. 16 in detail.

The fixed side mark 66 is formed with: a straight line mark 66*a* applied on the top surface of the holder 75 and on an extended line of the center line CL of the first bridge part 74*a*; and a vertical mark 66*b* extended vertically on the inner peripheral surface of the holder 75 from the distal end of the straight line mark 66*a*.

The moving side mark 67 is applied on the distal-end outer peripheral surface and the top surface of the first bridge part 74*a* on the center line CL of the first bridge part 74*a*.

Further, it is preferable to apply those fixed side mark 66 and the moving side mark 67 by carving or the like.

The extrusion die 10 of the second embodiment is structured in the manner described above, so that following effects can be acquired in addition to the same effects as those described in (1), (4), and (5).

(6) The uneven structure 77 and the step structure 78 are provided over the distal-end outer peripheral surfaces 74C of each of the bridge parts 74*a* to 74*d* of the spider 72 and the bridge holding surface 75C of a holder 75. Thus, when the holder 75 is cooled and contracted at the time of shrink-fitting the spider 72 and the holder 75, each of the structures 77 and 78 functions as stoppers for the slip-out direction. As a result, it is possible to prevent the spider 72 from being slipped out from the holder 75. Thereby, the both 72 and 75 can be bonded securely, which makes it possible to process still more highly precise hollow materials.

(7) The position check mark 65 constituted with the fixed side mark 66 and the moving side mark 67 is formed on the first bridge part 74*a* of the spider 72 and the holder 25, so that the fixed side mark 66 and the moving side mark 67 may simply be aligned when inserting the spider 22 to the heated and expanded holder 25. Thus, each of the bridge parts 74*a* to 74*d* can be easily disposed at prescribed positions.

Next, a third embodiment of the extrusion die according to the present invention will be described by referring to FIG. 17 and FIG. 18.

An extrusion die 10B according to the third embodiment is proposed in order to offset the pressure by bringing the surface that receives the pressure close to a position where there is a possibility of having a crack.

In the third embodiment, same reference numerals are applied to the same structures and the same members as those of the extrusion die 10 of the first embodiment, and only different points will be described.

Figure 17:
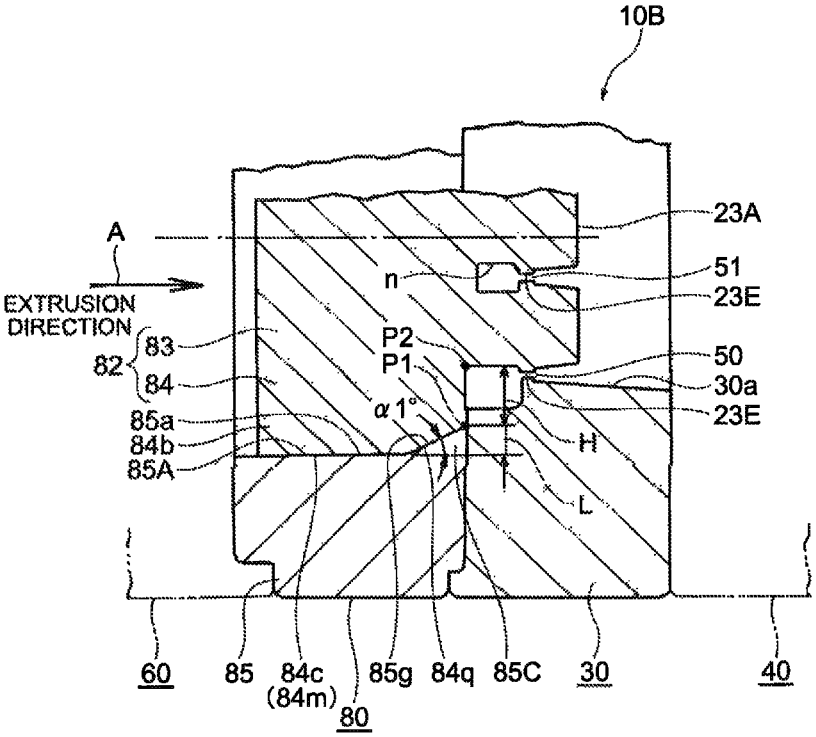
FIG. 17 is a vertical sectional view showing a third embodiment of the hollow material forming extrusion die according to the present invention, which is a vertical sectional view showing a state where a holder and a spider are unified by shrink-fitting.

FIG. 17 shows bonding of a distal-end outer peripheral surface 84C of a second bridge part 84*b* and a holder 85.

As shown in FIG. 17, a spider 82 is structured by including a mandrel 83 and a bridge part 84, and it is held by a holder 85.

Further, each of the distal-end outer peripheral surfaces 84C of the first to fourth bridge parts 84*a* to 84*d* (the second bridge part 84*b* in FIG. 17) constituting the bridge part 84 is formed with: a slope surface part 84*m* which is spread from the upstream side towards the downstream side; and an inverse slope surface part 84*q* which is formed at the end of the slope surface part 84*m* on the downstream side in a shape tapered towards the center side of the holder 85.

In the meantime, the bridge holding surface 85C of the holder 85 is formed with: a slope surface part 85*m* which corresponds to the slope surface part 84*m* of each of the bridge parts 84*a* to 84*d*; and an inverse slope surface part 85*q* which is formed at the distal end of the slope surface part 85*m* by corresponding to the inverse slope surface part 84*q*.

The part formed with the inverse slope surface part 85*q* forms a bridge receiving surface part 85A which receives the inverse slope surface part 84*q* and also functions to prevent the spider 82 from being slipped out from the holder 85.

Figure 18:
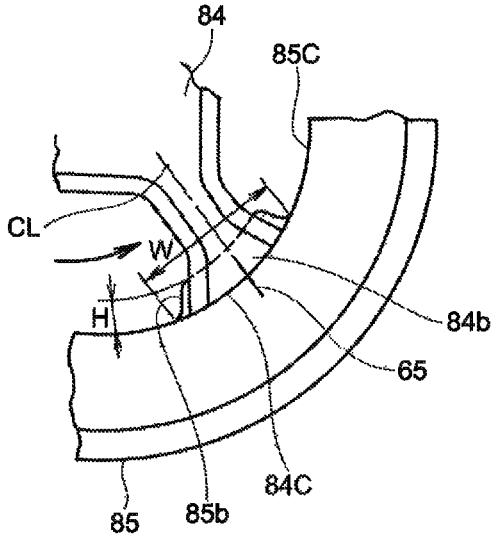
FIG. 18 is a plan view showing the relation between a single bridge part of the spider and a receiving surface part of the holder of the third embodiment.

As shown in FIG. 17 and FIG. 18, the inverse slope surface part 84*q* forming the distal-end outer peripheral surface 84C of the second bridge part 84*b* is tapered towards the center side of the holder 85 in a size H. In the meantime, the inverse slope surface part 85*q* of the holder 85 is formed in a protrusion amount of the size H and formed in a prescribed width W as shown in FIG. 18. As described above, the inverse slope surface part 85*q* is in a shape corresponding to the inverse slope surface part 84*q* of each of the bridge parts 84*a* to 84*d*.

The inverse slope surface part 85*q* of the holder 85 is tilted on the inverse slope surface 84*q* side of the bridge part 84 at an angle $\alpha 1$ degree with respect to the slope surface part 85*m* of the bridge holding surface 85C. Further, this angle $\alpha 1$ degree is set as about 30 degrees, for example.

The first bridge part 84*a*, the third bridge part 84*c*, and the fourth bridge part 84*d* are also in the same shape.

Note here that the distance between the base end point P1 of the bridge part 84 of the inverse slope surface part 85*q* of the holder 85 and the working point P2 in the direction orthogonal to the extrusion direction in the mandrel 83 from the base end point P1 is set as the size L, and the surface receiving the pressure is brought close to the position where there is a possibility of having a crack.

Thus, the moment generated at the working point P2 of the mandrel 83 can be reduced, so that the strength of the bridge part 84 can be increased. Thereby, breakage of the bridge part 84 which constitutes the spider 82 can be prevented. As a result, it becomes possible to perform high-speed extrusion and to extend the life even when extrusion-forming the billet constituted with a high-strength alloy with a high extrusion processing force, particularly constituted with the so-called 7000-system maximum strength aluminum alloy.

As described above, the inverse slope surface parts 85*q* are provided by corresponding to the respective inverse slope surface parts 84*q* of each of the bridge parts 84*a* to 84*d*, so that positions of the both are required to be aligned when inserting the spider 82 into the holder 85. Thus, in the third embodiment, the position check mark 65 is provided to the second bridge part 84*b* and the holder 85, for example, among the four bridge parts 84*a* to 84*d*.

As a result, the fixed side mark 66 and the moving side mark 67 may simply be aligned when inserting the spider 82 to the heated and expanded holder 85. Thus, each of the bridge parts 84*a* to 84*d* can be easily disposed at prescribed positions.

The extrusion die 10 of the third embodiment is structured in the manner described above, so that following effects can be acquired in addition to the same effects as those described in (1), (4), (5) and (7).

(8) The distance between the base end point P1 of the bridge part 84 of the inverse slope surface part 85*q* of the holder 85 and the working point P2 in the direction orthogonal to the extrusion direction in the mandrel 83 from the base end point P1 is set as the size L, and the surface receiving the pressure is brought close to the position where there is a possibility of having a crack.

Thus, the moment generated at the working point P2 of the mandrel 83 can be reduced, so that the strength of the bridge part 84 can be increased. Thereby, breakage of the first to fourth bridge parts 24*a* to 24*d* can be prevented. As a result, it becomes possible to perform high-speed extrusion and to extend the life even when extrusion-forming the billet B constituted with a high-strength alloy with a high extrusion processing force, particularly constituted with the so-called 7000-system maximum strength aluminum alloy.

While the present invention has been described by referring to each of the embodiments, the present invention is not limited only to each of the embodiments described above. Various kinds of modifications and changes occurred to those skilled in the art can be applied to the structures and details of the present invention. Further, the present invention includes a part of or a whole part of the structures of each of the embodiments combined mutually as appropriate.

Figure 13:
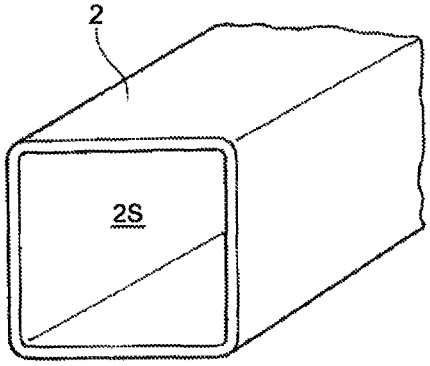
FIG. 13 is a sectional view showing the hollow material in a sectional shape having a rectangle with two vertically parallel lines formed by the hollow material forming extrusion die of the embodiment.

For example, while the hollow material 1 formed by the extrusion die 10 is in a sectional shape having a rectangle with two vertically parallel lines in the above-described embodiment, the shape is not limited to that. As shown in FIG. 13, it is possible to be used when forming a square sectional shape hollow material 2.

In such case, first, a substantially quadrangular prism shaped piece part is provided to the end part of the mandrel for forming an inside space S2 of the square sectional shaped hollow material 2 instead of the first inside piece part 23B, the second inside piece part 23C, and the third inside piece part 23D of the mandrel 23 of the spider 22 according to the embodiment. Further, a substantially square shaped external aperture corresponding to the substantially quadrangular prism shaped single piece part may be provided to the female die instead of the external shape aperture part 30C of the female die 30.

At this time, the engaged state and the tilt angle between the bridge distal-end outer peripheral surface 24C of the spider 22 and the bridge holding surface 25C of the holder 25 may be set as the same as the hollow material 1 in a sectional shape having a rectangle with two vertically parallel lines described above and the holder 25 can be used as it is. Therefore, it is possible to form a plurality of kinds of hollow materials with different sectional view shapes with a small number of use members.

Further, while the bridge horizontal shaking prevention parts 24D are provided between each of the first bridge 24*a* and the fourth bridge part 24*d* as well as between the second bridge part 24*b* and the third bridge part 24*c* and the like constituting the spider 22 and the like in the first embodiment, the shape of the bridge horizontal shaking prevention part 24D is not limited to that. For example, the structure shown in FIG. 19 may be employed.

Figure 19:
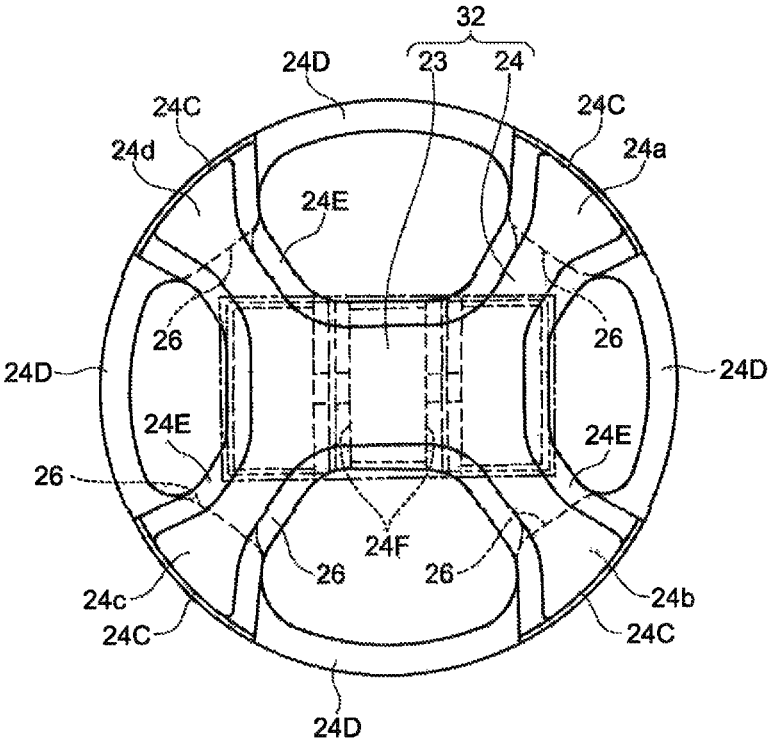
FIG. 19 is a plan view showing a modified mode of the spider according to the embodiment.
Figure 20:
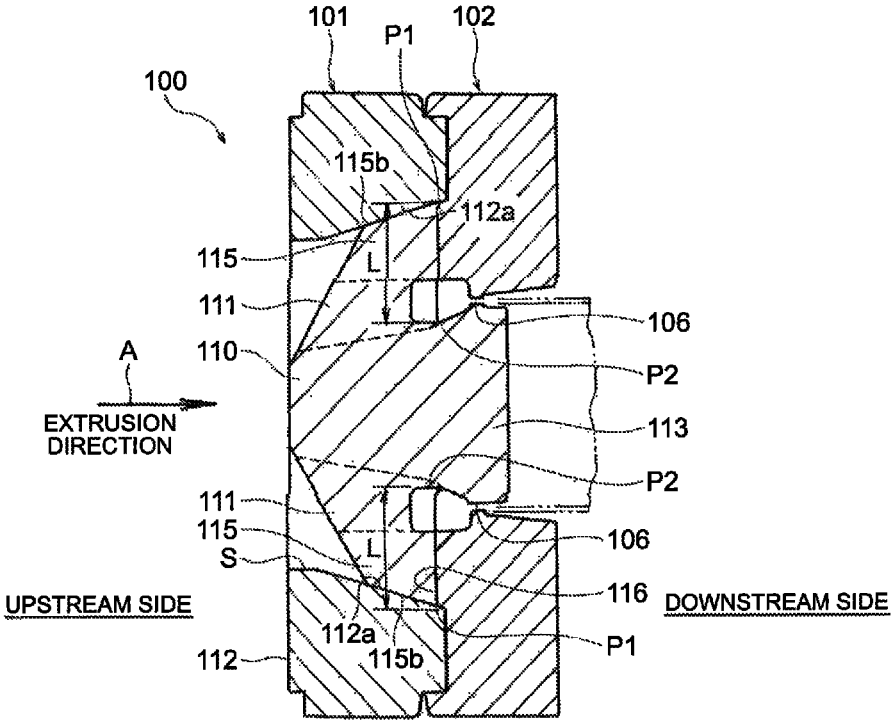
FIG. 20 is a vertical sectional view showing a conventional hollow material extrusion die.

In the modification embodiment shown in FIG. 19, the bridge horizontal shaking prevention parts 24D are provided in all the sections between each of the first to fourth bridge parts 24*a* to 24*d*. Further, in such modified mode, four bridge horizontal shaking prevention parts 24D connecting the four bridge parts 24*a* to 24*d* are provided, so that more horizontal shaking prevention effect can be acquired.

Further, while the distal-end outer peripheral surface 24C of each of the bridge parts 24*a* to 24*d* are formed with the slope surface part 24*m* and the straight line part 24*n* and the bridge holding surface 25C is formed with the slope surface part 25*m* and the straight line surface part 25*n* in the first embodiment, the structures are not limited to that. For example, the entire surfaces of each of the distal-end outer peripheral surface 24C and the bridge holding surface 25C may be formed with the straight line surface parts. With such structure, it is also possible to insert each of the bridge parts 24*a* to 24*d* of the spider 22 into the bridge holding surface 25C of the holder 25 since the inner peripheral surface inside diameter of the bridge holding surface 25C is increased as a result of heating and expanding the holder 25 at the time of shrink-fitting.

With such modified mode, processing of the distal-end outer peripheral surface 24C of each of the bridge parts 24*a* to 24*d* and the processing of the bridge holding surface 25C can be done easily.

Further, while the uneven structure 77 is provided to the first bridge part 74*a* and the fourth bridge part 74*d* as well as the holder 75 and the step structure 78 is provided to the second bridge part 74*b* and the third bridge part 74*c* as well as the holder 75, respectively, in the second embodiment, the structures are not limited only to that. For example, the uneven structure 77 in the same shape as that of the uneven structure 77 described above may be provided to all of the bridge parts 74*a* to 74*d* or the step structure 78 in the same shape as that of the step structure 78 described above may be provided to all of the bridge parts 74*a* to 74*d*.

Further, when the uneven structure 77 same as the uneven structure 77 is provided to all of the bridge parts 74*a* to 74*d*, the entire circumference of the bridge holding surface part 75C of the holder 75 may be corresponded to the uneven structure 77.

With such structure, a same kind of projected surface parts 77*a* constituting the uneven structure 77 may simply be formed in the distal-end outer periphery of the first to fourth bridge parts 74*a* to 74*d*, and a same kind of recessed surface parts 77*b* may simply be formed on the entire circumference of the bridge holding surface part 75C of the holder 75. Thus, the processing can be done more easily than the case of the second embodiment.

Further, when the step structure 78 same as the step structure 78 is provided to all of the bridge parts 74*a* to 74*d*, the entire circumference of the bridge holding surface part 75C of the holder 75 may be corresponded to the step structure 78.

With such structure, the step surface parts 74*f* may be simply be formed in the distal-end outer periphery of the first to fourth bridge parts 74*a* to 74*d*, and the step receiving surface parts 75*b* may simply be formed on the entire circumference of the bridge holding surface part 75C of the holder 75. Thus, the processing can be done more easily than the case of the second embodiment.

Further, while the uneven structure 77 and the strep structure 78 are formed at positions somewhere on the slope surface part 74*m* and the straight line part 74*n* is formed at the distal end thereof in the distal-end outer peripheral surface parts 74C of all of the bridge parts 74*a* to 74*d* in the second embodiment, the structures are not limited to that.

The uneven structure 77 and the step structure 78 are formed on the distal-end surface parts 74C of each of the bridge parts 74*a* to 74*d*, and those uneven structure 77 and the step structure 78 are bonded to the bridge holding surface 75Ca of the holder 75 by shrink-fitting. Thus, there is no risk that the spider 72 is slipped out from the bridge holding surface part 75C of the holder 75 when extruding out the billet B. Therefore, unlike the second embodiment, it is not necessary to form the straight line part 74*n* at the tip of the distal-end outer peripheral surface parts 74C of the bridge parts 74*a* to 74*d*.

INDUSTRIAL APPLICABILITY

The extrusion die according to the present invention is used when forming a hollow material constituted with a high-strength alloy, particularly with the so-called 7000-system maximum strength aluminum alloy.

REFERENCE NUMERALS

1 Hollow material in a sectional shape having a rectangle with two vertically parallel lines Hollow material forming extrusion die (first embodiment)
10A Hollow material forming extrusion die (second embodiment)
10B Hollow material forming extrusion die (third embodiment)
20 Male die
22 Spider
23 Mandrel
23B Inside forming projected part
24 Bridge part
24*a* to 24*d* First to fourth bridges
24*m* Slope surface part
24*n* Straight line part
24C Bridge distal-end outer peripheral surface
25 Holder
25C Bridge holding surface
25*m* Slope surface part
25*n* Straight line part
30 Female die
30B Material external shape aperture
50 Material forming hole part
51 Material forming hole part
70 Hollow material forming extrusion die (second embodiment)
80 Hollow material forming extrusion die (third embodiment)
A Billet extrusion direction
B Billet
S Billet introduction space

The invention claimed is:

1. An extrusion die for forming a hollow material, comprising: a male die which forms an inside shape of the hollow material by extruding a billet constituted with an aluminum alloy fed from an upstream side towards a downstream side; and a female die which holds the male die and forms an outside shape of the hollow material, wherein:

the male die comprises a spider which forms the inside shape and a holder which holds the spider;

the spider comprises a mandrel which corresponds to the inside shape of the hollow material, and a plurality of bridge parts provided in a unified manner with the mandrel and projecting outward from a periphery of the mandrel;

a distal-end outer peripheral surface part of each of the bridge parts is formed with a slope surface part which is expanded from the upstream side towards the downstream side and a straight live surface part formed at a downstream side end part of the slop surface part along an extrusion direction of the billet;

an inner peripheral surface part of the holder is formed with (i) a holder-side slope surface part corresponding to a slope surface part of the distal-end outer peripheral surface part of the bridge part and (ii) a holder-side slope surface part and a straight line surface part corresponding to the straight line surface part of the bridge part, and the distal-end outer peripheral surface part of each of the bridge parts and the inner peripheral surface part of the holder are bonded by shrink-fitting.

2. The extrusion die for forming a hollow material as claimed in claim 1, wherein:

a projected surface part projected towards the inner peripheral surface part of the holder is provided at a position somewhere on the slope surface part of the distal-end outer peripheral surface of the two bridge parts among each of the four bridge parts;

a step surface part projected towards the inner peripheral surface part of the holder is provided at a position somewhere on the slope surface part of the distal-end outer peripheral surface of the remaining two bridge parts among each of the four bridge parts; and the entire inner peripheral surface of the holder is formed with a slope surface part and a straight line surface part corresponding, respectively, to the slope surface part and the straight line surface part of the distal-end outer peripheral surface part of the bridge part, and a recessed surface part corresponding to the projected surface of the two bridge parts and a step receiving surface part corresponding to the step surface part of the two remaining bridge parts are formed at positions somewhere on the slope surface part.

3. An extrusion die for forming a hollow material, comprising: a male die which forms an inside shape of the hollow material by extruding a billet constituted with an aluminum alloy fed from an upstream side towards a downstream side; and a female die which holds the male die and forms an outside shape of the hollow material, wherein:

the male die comprises a spider which forms the inside shape and a holder which holds the spider;

the spider comprises a mandrel which corresponds to the inside shape of the hollow material, and a plurality of bridge parts provided in a unified manner with the mandrel and projected outward from a periphery of the mandrel;

the bridge parts are formed with four pieces which are disposed in an X-letter shape on a plan view;

a bridge horizontal shaking prevention part for preventing horizontal shaking is provided along the inner peripheral surface part of the holder at the downstream side end part between each of the two neighboring bridge parts among each of the four bridge parts; and the bridge horizontal shaking prevention part is provided at least at two points by sandwiching the mandrel.

4. An extrusion die for forming a hollow material, comprising: a male die which forms an inside shape of the hollow material by extruding a billet constituted with an aluminum alloy fed from an upstream side towards a downstream side; and a female die which holds the male die and forms an outside shape of the hollow material, wherein:

the male die comprises a spider which forms the inside shape and a holder which holds the spider;

the spider comprises a mandrel which corresponds to the inside shape of the hollow material, and a plurality of bridge parts provided in a unified manner with the mandrel and projected outward from a periphery of the mandrel;

the distal-end outer peripheral surface of each of the bridge parts is formed with a slope surface part expanded from the upstream side towards the downstream side and an inversed slope surface part which is formed at an end part of the slope surface part on the downstream side in a shape tapered towards a center side of the holder; and an inner peripheral surface part of the holder is formed with a holder-side slope surface part corresponding to the slope surface part of the distal-end outer peripheral surface of the bridge part and a holder-side holding surface part which corresponds to the inverse slope surface part and holds the inverse slope surface part; and the distal-end outer peripheral surface part of each of the bridge parts and the inner peripheral surface part of the holder are bonded by shrink-fitting.

* * * * *